US009633629B2

(12) United States Patent
Schimmel-Vogel et al.

(10) Patent No.: US 9,633,629 B2
(45) Date of Patent: Apr. 25, 2017

(54) PIANO OR GRAND PIANO WITH STRINGS AND A SOUND BRIDGE WITH REDUCED MASS AND IMPROVED TONAL QUALITY

(71) Applicant: VIOGA GmbH, Braunschweig (DE)

(72) Inventors: Hannes Schimmel-Vogel, Braunschweig (DE); Nikolaus Schimmel, Braunschweig (DE)

(73) Assignee: SCHIMMEL-VERWALTUNGSGESELLSCHAFT MIT BESCHRANKTER HAFTUNG, Braunschweig (DE)

( * ) Notice: Subject to any disclaimer, the term of this patent is extended or adjusted under 35 U.S.C. 154(b) by 78 days.

(21) Appl. No.: 14/380,930

(22) PCT Filed: Mar. 6, 2013

(86) PCT No.: PCT/EP2013/054479

§ 371 (c)(1),
(2) Date: Aug. 25, 2014

(87) PCT Pub. No.: WO2013/131944

PCT Pub. Date: Sep. 12, 2013

(65) Prior Publication Data

US 2015/0047492 A1 Feb. 19, 2015

(30) Foreign Application Priority Data

Mar. 6, 2012 (DE) ..... 10 2012 004 235

(51) Int. Cl.

| | |
|---|---|
| ***G10C 3/04*** | (2006.01) |
| ***G10C 3/06*** | (2006.01) |
| ***G10C 1/04*** | (2006.01) |

(52) U.S. Cl.
CPC ..... *G10C 3/06* (2013.01); *G10C 1/04* (2013.01); *G10C 3/04* (2013.01)

(58) Field of Classification Search
USPC ..... 84/187
See application file for complete search history.

(56) References Cited

U.S. PATENT DOCUMENTS 1,476,014 A * 12/1923 Jones ..... G10C 3/08 84/212
1,753,389 A * 4/1930 Schwechten ..... G10C 3/08 84/212

(Continued)

FOREIGN PATENT DOCUMENTS

AT 220929 B 4/1962
CN 201975055 U 9/2011

(Continued)

*Primary Examiner* — Christopher Uhlir
(74) *Attorney, Agent, or Firm* — Barlow, Josephs & Holmes, Ltd.

(57) ABSTRACT

The present invention relates to a piano or a grand piano with a resonance board and strings which rest on a sound bridge with two longitudinal faces. Such a sound bridge serves to transmit vibration energy which is output by the strings of the instrument to a resonance board. The invention is based on the realization that, on the one hand, the rigidity of the sound bridge must be maintained at the locations at which it is in contact with the strings and the resonance board. On the other hand, it is advantageous if the mass of the sound bridge is reduced. For this reason, according to the invention it is proposed that the sound bridge have a first cutout and a second cutout, wherein the two cutouts are arranged on the two longitudinal edges of the sound bridge which lie opposite one another.

16 Claims, 1 Drawing Sheet

(56) References Cited

U.S. PATENT DOCUMENTS

| | | | | | |
|---|---|---|---|---|---|
| 2,071,992 | A | * | 2/1937 | White | G10C 1/04<br>84/184 |
| 2,206,650 | A | * | 7/1940 | Sperry | G10C 3/06<br>84/189 |
| 2,217,021 | A | * | 10/1940 | Klepae | G10C 3/04<br>84/188 |
| 3,468,207 | A | * | 9/1969 | Noda | G10C 3/06<br>84/209 |

FOREIGN PATENT DOCUMENTS

| | | | |
|---|---|---|---|
| DE | 326629 | C | 9/1920 |
| DE | 418187 | C | 9/1925 |
| DE | 506687 | C | 9/1930 |
| DE | 676912 | C | 6/1939 |
| DE | 2915959 | A1 | 10/1980 |
| DE | 3929726 | A1 | 3/1991 |
| DE | 202008005780 | U1 | 7/2008 |
| DE | 102012004235 | A1 | 9/2013 |
| EP | 0050314 | A2 | 4/1982 |
| GB | 197063 | | 5/1923 |
| WO | 9521442 | A1 | 8/1995 |
| WO | 9957708 | A1 | 11/1999 |

* cited by examiner

PIANO OR GRAND PIANO WITH STRINGS AND A SOUND BRIDGE WITH REDUCED MASS AND IMPROVED TONAL QUALITY

CROSS-REFERENCE TO RELATED APPLICATIONS

This patent document is a 371 of international application PCT/EP2013/054479, filed on Mar. 6, 2013, which claimed priority to earlier filed German Application No. DE 10 2012 004 235.3, filed on Mar. 6, 2012.

BACKGROUND OF THE INVENTION (1) Field of the Invention

The present invention relates to a piano or grand piano with a resonance board and strings, which rest on a sound bridge with two longitudinal faces.

(2) Description of the Related Art

Pianos and grand pianos, in particular concert grand pianos, belong to pianoforte instruments. They are strings instruments and are generally known. They have a resonance board, on which a bridge, which is usually referred to as a sound bridge, is mounted. Lying on such a sound bridge are strings, which are guided by bridge pegs and can be induced to vibrate by the striking of hammer heads. The transmission of the energy produced by this vibration to the resonance board occurs by means of the sound bridge, which is usually adhesively bonded to the resonance board.

There are also sound bridges of entirely different form for stringed instruments, such as, for instance, violins, which are also included among the stringed instruments. However, the requirements for sound bridges in the case of violins and other instruments are different. Not only is the dimension smaller by an order of magnitude, but also the number of resonating strings is nearly always in the single digits, whereas, in the case of a piano, there are more than 100 individual strings. In the case of pianos and grand pianos, very large tensile forces prevail in comparison to violins and stringed instruments and substantial compressive forces are imposed on the sound bridge; these forces do not exist for stringed instruments. Sound bridges for stringed instruments are very delicate components, whereas very massive and heavy sound bridges, which are capable of withstanding the forces and loads, are used in pianos and grand pianos.

The lateral extension of a sound bridge is also substantial in the case of pianos and grand pianos. Under certain circumstances, they can be up to 2000 mm or possibly even greater in grand pianos. In stringed instruments, the maximal length lies at about 150 mm.

The lateral extension of the sound bridge is not purely rectilinear, but rather indeed runs in a slight curved shape on the resonance board of a grand piano, such as, for example, a concert grand piano.

Owing to the aforementioned requirements, sound bridges are regarded, above all, as support structures for the strings and are intentionally constructed in an appropriately robust and massive fashion for accommodating the forces.

As additional stabilization of the sound bridge on the resonance board, WO 99/57708 A1 proposes that the sound bridge is equipped with bridge tabs at its two ends or that it be lengthened overall and provided with beveled end portions. These bridge tabs or beveled end portions can then be fixed in place on the resonance board. It is further provided that the resonance board additionally be adhesively bonded in this region with underlying catches.

Known from WO 95/21442 A1 is a resonance board with a first sound bridge and a second bass bridge. The bass bridge is designed as a bridge and is composed of a plurality of separate parts. The design of the bridge is intended to shift the introduction of vibrations into the resonance board over a certain distance. Provided for further reinforcement are metallic supporting elements and other components. A glass layer and damping material are also provided for certain purposes. The actual sound bridge has a continuous right-angled cross section.

Further examples of pianos and grand pianos with a combination of resonance board and sound bridge are described, for example, in DE 326 629 C, DE 506 687 C, DE 676 912 C, DE 29 15 959 C2, as well as in DE 39 29 726 A1.

In spite of the very numerous attempts in the prior art to continue to improve insofar as possible the quality and also the tonal quality of pianos and grand pianos, there still is interest in creating further possibilities here.

BRIEF SUMMARY OF THE INVENTION

The object of the present invention is therefore to improve the tonal quality of a piano or grand piano of the kind mentioned.

This object is achieved by the invention for a generic piano or grand piano in that the sound bridge has a first cutout and a second cutout, wherein the two cutouts are arranged on the two longitudinal faces of the sound bridge that lie opposite each other.

The object is surprisingly achieved through these ideas. The provision of cutouts in the longitudinal faces of the sound bridge initially seems absurd to the person skilled in the art. As explained, it has been assumed that, in the case of pianos and grand pianos, the sound bridges would have to be designed as massively and as stable as possible owing to the substantial loads and forces. As pointed out in WO 95/21442 A1, for instance, and also in several other publications, the sound bridge should have a cross section that is as right-angled as possible. However, a departure in this very respect is made according to the invention.

As can namely be inferred by deliberation, it is indeed important to maintain the appropriate stability. However, this can also be achieved in that the sound bridge has a high rigidity at the contact surfaces to the resonance board and also at the contact surfaces to the strings.

If the rigidity is achieved in these two critical regions, it is advantageous when the weight of the sound bridge is reduced, since, in this way, there is less mass in the system that needs to be induced to vibrate.

Proceeding from this realization, the present invention provides that cutouts are provided in the sound bridge on the sides or, in other words, on the longitudinal faces. Sides or longitudinal faces are understood here to mean those faces that run along the sound bridge and are normally neither in direct contact with the resonance board nor in direct contact with the strings. These lateral faces thus lie opposite to each other. They can as such have a rectilinear course, an arched course, or another suitable course. The cutouts can have, for example, the form of fillets and they can be produced by milling the blank of the sound bridge or the like.

As a result of such cutouts, the material cross section in the middle of the sound bridge is reduced, thereby increasing its flexibility. In this way, the interaction with the vibrating resonance board can take place with lower energy losses.

The leverage ratios in the bridge cross section, for example, can lead to an increase in the dynamic transmission rates by approximately 18%.

In addition, it has been found that it is especially advantageous when the cutouts are arranged symmetrically or at least substantially symmetrically within a cross section in relation to a vertical axis. Cross section is understood here to mean a section through the sound bridge that runs nearly perpendicular to the longitudinal direction and hence also perpendicular to the longitudinal faces or sides.

Owing to the strings that rest on the sound bridge, vertical forces are introduced into the sound bridge, the lines of force of which must point in the same direction both without the cutouts and also with the cutouts. When material is removed from the sound bridge body on one side or in an asymmetrical manner, the direction of the lines of force can be influenced and, as a result, a deformation of the sound bridge can occur. In order to prevent this effect, it is necessary to ensure insofar as possible that the symmetry of the sound bridge is maintained with respect to the vertical axis within the cross section.

It is advantageous when the cutouts do not exceed a certain size in terms of their form, because it has been found that the positive influence on the vibrational properties of the sound bridge functions only up to a certain threshold. Above such a threshold, the relative effect caused by the material removed in order to introduce the cutouts is too great and the stability of the sound bridge component is decreased too strongly. It has been found that such a threshold lies at 8-10% in relation to the relative decrease in component volume within a cross section or over the cross section. Up to this threshold, the reduction in stability is acceptable and the flexibility of the sound bridge that is thereby increased is advantageous with respect to its vibrational properties.

It has been further found that it is advantageous to alter the dimensions of the cutouts over the length of the sound bridge. This is based on the realization that the fundamental tones produced in the strings instrument cover a frequency range of 24 Hz (bass) to 5000 Hz (descant or treble) and that the self-resonance of the sound bridge should be adaptable to the applied frequency. Such a fine adjustment occurs via the relative volume reduction, with more material being removed for the lower frequencies and less material for the higher frequencies. It has been found that relative volume reductions over the cross section in the range of 3 to 10% are appropriate. Especially suitable for this is the range between 5 and 8%. This can be provided, for example, by altering the depth of penetration of a cutting or milling tool in the sound bridge blank, said tool being part of a high-precision CNC (computerized numerical control) machine tool.

Advantageous further developments may be taken from the dependent claims and the following description of exemplary embodiments.

BRIEF DESCRIPTION OF THE SEVERAL VIEWS OF THE DRAWINGS

Further details and advantages of the present invention are described in the following on the basis of preferred exemplary embodiments. Shown are.

DETAILED DESCRIPTION OF THE INVENTION

Figure 1:
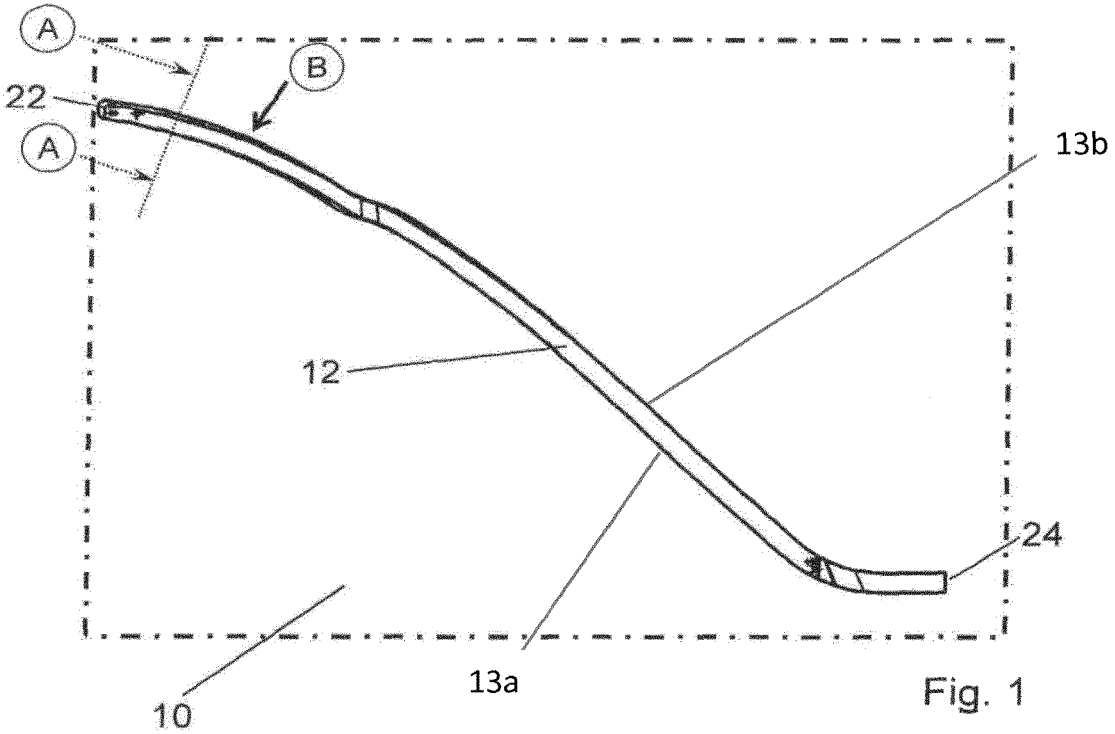
FIG. 1 a plan view of a resonance board with a sound bridge.

FIG. 1 shows in plan view a symbolically illustrated resonance board 10, which is part of a strings instrument, such as, in particular, a piano or grand piano. Attached to this resonance board 10 is a bridge 12—referred to in the following as a sound bridge—this attachment preferably provided by adhesive bonding. In the illustrated example, the bridge 12 runs on the top side of the resonance board 10 over a substantial distance. It can be seen that the bridge 12 does not run in a purely rectilinear manner, but rather has several bends or curves.

The bridge has essentially the same width everywhere over its entire longitudinal extension. Its longitudinal extension is substantially greater than its width.

The bridge thus has a first bridge end 22 and a second bridge end 24. It is oriented in FIG. 1 with its top side facing the viewer and lies with its bottom side (not seen) on the resonance board 10. Its left side and its right side are identified here in a simplified manner as longitudinal faces 13*a* and 13*b*. They run over the entire length of the bridge 12.

Figure 2:
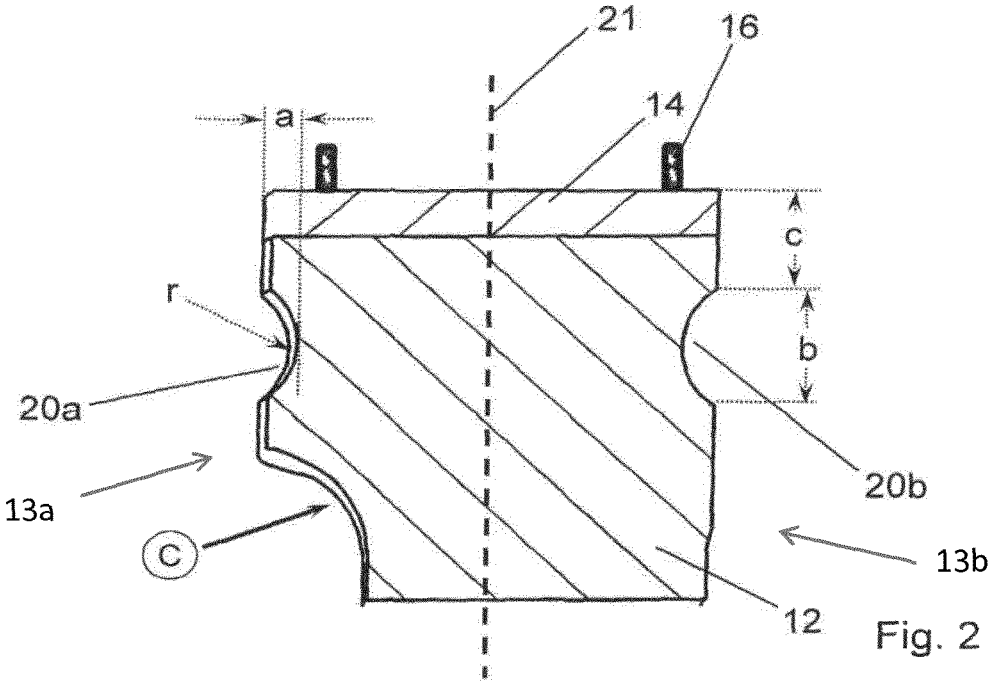
FIG. 2 a cross-sectional view along the line A-A from FIG. 1.

FIG. 2 is a cross-sectional illustration along the line A-A (FIG. 1). A cross section shown in this way is thus a section that, in relation to the two sides of the bridge or the longitudinal faces 13*a*, 13*b*, runs nearly perpendicularly.

The sound bridge 12 has a bridge cap 14 on its top side. In addition, a plurality of bridge pegs 16, which, in this case, do not guide illustrated strings, are mounted there. The strings can be induced to vibrate by a plurality of hammer heads (not illustrated) and their vibrational energy is transmitted via the sound bridge 12 to the resonance board 10.

In the preferred embodiment, the sound bridge 12 has a length of about 150 cm, a height—including the bridge cap 14—of about 3.4 cm and a width of about 3.4 cm. It is noted that the dimensions of sound bridges can be quite different. This usually depends on the type of instrument in which they are employed. In particular, the sound bridge lengths can be up to 250 cm.

It can be seen in FIG. 2, in particular, that the sound bridge 12 has cutouts 20*a* and 20*b*, which will be referred to as fillets and described in detail below, on each of its two sides or longitudinal faces 13*a*, 13*b*. The first fillet 20*a* is located on the left side or on the first longitudinal face 13*a* (with reference to the illustration in FIG. 2) of the sound bridge 12 and the second fillet 20*b* is located on the right side or on the second longitudinal face 13*b*. In the preferred embodiment, the two fillets 20 are formed and arranged in such a manner that they are symmetrical with respect to the vertical axis 21 of the cross section depicted. The two fillets 20 are shaped similarly to the arc of a circle, which, in this case, has a radius r of 6 mm along the section A-A (FIG. 1). Its innermost point projects in each case by a distance a (here, 3 mm) into the sound bridge 12. Accordingly, each of them extends vertically (FIG. 2) along the sides or the longitudinal faces 13*a*, 13*b* of the sound bridge 12 by the length b (here, 10 mm). The top edges of the fillet 20 are located at a distance c (here, 9 mm) from the top edge of the sound bridge 12 or, more specifically, from the top edge of the bridge cap 14.

It has been found that it is advantageous when the dimensions of the fillets 20 along the sound bridge 12 are varied and namely in such a manner that more material is removed at low frequencies and less material is removed at higher frequencies. This is accomplished during fabrication in that the depth of penetration of the cutting tool into the blank of the sound bridge 12 is altered. Preferably, the relative reduction in the component volume varies over the cross section by between 5 and 8%. Thus, in the preferred embodiment, for example, the fillets 20 have the following dimensions at the place marked by the arrow B (FIG. 1):

r=6 mm; a=3.8 mm, b=11 mm, c=9.5 mm.

Preferably, the fillets 20 extend nearly over the entire length of the sound bridge 12 along the longitudinal faces 13*a*, 13*b*. However, they end at a predetermined distance before the first bridge end 22 or before the second bridge end 24. In the preferred embodiment, the fillets 20 run toward their ends along the arc of a circle, this being determined essentially by the milling process during their processing.

It can further be seen in FIG. 2 that the cross section of the sound bridge 12 has another concavity (or fillet) on the bottom left side (arrow C) or longitudinal face 13*a*. This concavity or fillet in the longitudinal face 13*a* is not provided over the entire region or over the entire length of the sound bridge 12, but rather, first and foremost, in the register of the high descant. This is thus the register of especially high tones, usually on the extreme right side of the piano or grand piano, as viewed by the pianist, and hence also of the resonance board. In FIG. 1, this would be in the vicinity of the second bridge end 24 and less in the region of the sectional line A-A.

In this register of the high descant, the distance between the sound bridge 12 and a bottom support, that is, that edge on which the resonance board 10, in turn, is adhesively bonded, is at a minimum.

There is interest in arranging the point of introduction of energy from the sound bridge 12 into the resonance board 10 as far as possible from the bottom support, that is, to keep it in a region of the resonance board 10 that is as flexible as possible. A similar effect also concerns the bridge for the bass bridge in WO 95/21442 A1 already outlined in the introduction of the description. This goal is attained by way of the region marked with arrow C, where material has been removed.

This is thus an elemental feature of the basic geometry of the sound bridge 12 and the effect of this additional concavity, which runs only over a subregion of the length of the sound bridge 12, may not be altered by the symmetric fillets 20*a*, 20*b*.

In the range of the middle and moderately high tones, that is, in the tenor range and not-too-high descant, and also in the range of the strings that represent the moderately deep tones and are still carried on the sound bridge and not on the bass bridge, this concavity is therefore not present. Consequently, the fillets 20*a* and 20*b* according to the invention are the sole cutouts in the two longitudinal faces 13 * and 13*b* of the sound bridge 12, at least in this portion of the sound bridge 12 located in FIG. 1 on the left or in the middle of the resonance board 10.

sic; longitudinal faces 13*a*?—Translator's Note

The exemplary embodiments are described only by way of example and may be modified or combined with one another in diverse ways. Thus, the following, in particular, is possible:

The fillets 20*a* and 20*b* may have any other cross section instead of a cross section resembling the arc of a circle, such as an elliptical cross section, a rectangular cross section, or the like.

It is also possible to arrange more than one fillet 20 on each of the bridge sides.

LIST OF REFERENCE SYMBOLS

10 resonance board
12 sound bridge
13*a* first longitudinal face of the sound bridge
13*b* second longitudinal face of the sound bridge
14 bridge cap
16 bridge peg
20*a, b* fillets
21 vertical axis of the sound bridge
22 first bridge end
24 second bridge end
r radius of the fillets
a depth of penetration of the fillets
b vertical extension of the fillets
c distance of the fillets from the top bridge edge
d distance of the fillets from the bridge end
A-A sectional line (for FIG. 2)
B arrows
C arrow or concavity

The invention claimed is:

1. A piano or grand piano,
with a resonance board and strings, which rest on a sound bridge (12) with two longitudinal faces (13*a*, 13*b*),
characterized
in that the sound bridge (12) has a first cutout (20*a*) and a second cutout (20*b*), with the two cutouts (20*a*, 20*b*) being arranged on the longitudinal faces (13*a*, 13*b*) of the sound bridge (12) that lie opposite each other;
the two cutouts (20*a*, 20*b*) run over an entire length of the longitudinal faces (13*a*, 13*b*) of the sound bridge (12) with the exception-of portions adjacent to the two opposing ends (22, 24);
wherein a relative reduction in a component volume varies over a length of the sound bridge (12) in a longitudinal direction by varying the depth of the two cutouts (20*a*, 20*b*) in the sound bridge (12) inwards relative to a vertical axis (21) of the sound bridge (12) where more material is removed at low frequencies and less material is removed at higher frequencies;
the sound bridge having high rigidity at a contact surface to the resonance board.

2. The piano or grand piano according to claim 1,
further characterized
in that the two cutouts (20*a*, 20*b*) are arranged and designed such that they are approximately symmetrical in relation to a vertical axis (21) of the sound bridge (12) within a cross section of the sound bridge (12).

3. The piano or grand piano according to claim 1,
further characterized
in that, in addition to the cutouts (20*a*, 20*b*), a concavity (C) is provided in one of the two opposite-lying longitudinal faces (13*a*) in a portion of the sound bridge (12) that is provided for accommodating the strings of a high descant, and that this concavity (C) in a cross section of the sound bridge (12) occupies a transition region from a side that is adjacent to the resonance board (10) to the longitudinal face (13*a*), wherein concavity (C) is formed inwardly in the sound bridge relative to the vertical axis (21).

4. The piano or grand piano according to claim 1,
further characterized
in that a relative reduction in a component volume over a cross section of the sound bridge (12) is between 3 and 10%.

5. The piano or grand piano according to claim 1,
further characterized
in that the cutouts (20*a*, 20*b*) have a circular cross section.

6. The piano or grand piano according to claim 2,
further characterized
in that, in addition to the cutouts (20*a*, 20*b*), a concavity (C) is provided in one of the two opposite-lying longitudinal faces (13*a*) in a portion of the sound bridge (12) that is provided for accommodating the strings of a high descant, and that this concavity (C) in a cross section of the sound bridge (12) occupies a transition region from a side that is adjacent to the resonance board (10) to the longitudinal face (13*a*), wherein concavity (C) is formed inwardly in the sound bridge relative to the vertical axis (21).

7. The piano or grand piano according to claim 2, further characterized in that a relative reduction in a component volume over a cross section of the sound bridge (12) is between 3 and 10%.

8. The piano or grand piano according to claim 1, further characterized in that a relative reduction in a component volume over a cross section of the sound bridge (12) is between 5 and 8%.

9. The piano or grand piano according to claim 3, further characterized in that a relative reduction in a component volume over a cross section of the sound bridge (12) is between 3 and 10%.

10. The piano or grand piano of claim 1, further comprising a bridge cap (14) on a top side of the sound bridge (12).

11. A piano or grand piano, comprising:

a resonance board and strings, which rest on a sound bridge (12) with two longitudinal faces (13*a*, 13*b*), wherein the sound bridge (12) has a first cutout (20*a*) and a second cutout (20*b*), with the two cutouts (20*a*, 20*b*) being arranged on the longitudinal faces (13*a*, 13*b*) of the sound bridge (12) that lie opposite each other;

the two cutouts (20*a*, 20*b*) run over an entire length of the longitudinal faces (13*a*, 13*b*) of the sound bridge (12) with the exception-of portions adjacent to the two opposing ends (22, 24);

wherein a relative reduction in a component volume varies over a length of the sound bridge (12) in a longitudinal direction by varying the depth of the two cutouts (20*a*, 20*b*) in the sound bridge (12) inwards relative to a vertical axis (21) of the sound bridge (12) where more material is removed at low frequencies and less material is removed at higher frequencies; and a concavity (C) is provided in one of the two opposite-lying longitudinal faces (13*a*) in a portion of the sound bridge (12) that is provided for accommodating the strings of a high descant, and that this concavity (C) in a cross section of the sound bridge (12) occupies a transition region from a side that is adjacent to the resonance board (10) to the longitudinal face (13*a*), wherein concavity (C) is formed inwardly in the sound bridge relative to the vertical axis (21);

the sound bridge having high rigidity at a contact surface to the resonance board.

12. The piano or grand piano of claim 11, further comprising a bridge cap (14) on a top side of the sound bridge (12).

13. The piano or grand piano according to claim 11, wherein a relative reduction in a component volume over a cross section of the sound bridge (12) is between 3 and 10%.

14. The piano or grand piano according to claim 11, wherein a relative reduction in a component volume over a cross section of the sound bridge (12) is between 5 and 8%.

15. The piano or grand piano according to claim 11, wherein the two cutouts (20*a*, 20*b*) are arranged and designed such that they are approximately symmetrical in relation to a vertical axis (21) of the sound bridge (12) within a cross section of the sound bridge (12).

16. The piano or grand piano according to claim 11, wherein the cutouts (20*a*, 20*b*) have a circular cross section.

* * * * *